US008057978B2

(12) United States Patent
Yamaguchi et al.

(10) Patent No.: US 8,057,978 B2
(45) Date of Patent: Nov. 15, 2011

(54) TONER FOR ELECTROPHOTOGRAPHY

(75) Inventors: Go Yamaguchi, Tokyo (JP); Yoshiaki Kobayashi, Tokyo (JP); Asao Matsushima, Tokyo (JP); Noboru Ueda, Tokyo (JP); Masaharu Matsubara, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 594 days.

(21) Appl. No.: 12/205,100

(22) Filed: Sep. 5, 2008

(65) Prior Publication Data

US 2009/0087770 A1 Apr. 2, 2009

(30) Foreign Application Priority Data

Sep. 29, 2007 (JP) ..... 2007-256938

(51) Int. Cl.
*G03G 9/00* (2006.01)

(52) U.S. Cl. ..... 430/109.3; 430/109.4; 430/111.4

(58) Field of Classification Search ..... 430/108.1, 430/108.3, 108.4, 108.8, 109.3, 109.4, 110.2, 430/111.4, 123.53
See application file for complete search history.

(56) References Cited

U.S. PATENT DOCUMENTS

| | | | | |
|---|---|---|---|---|
| 5,242,777 | A * | 9/1993 | Kato et al. | 430/109.5 |
| 5,851,714 | A * | 12/1998 | Taya et al. | 430/108.3 |
| 5,955,234 | A * | 9/1999 | Matsunaga et al. | 430/109.3 |
| 6,235,441 | B1 * | 5/2001 | Tanikawa et al. | 430/108.21 |
| 2003/0134215 | A1 * | 7/2003 | Kashiwabara et al. | 430/108.4 |
| 2008/0020316 | A1 * | 1/2008 | Hirano et al. | 430/111.4 |

* cited by examiner

*Primary Examiner* — Mark F Huff
*Assistant Examiner* — Stewart Fraser
(74) *Attorney, Agent, or Firm* — Lucas & Mercanti, LLP

(57) ABSTRACT

An electrophotographic toner is disclosed, meeting the requirement that G' (60)/G' (80) is from $1\times10^2$ to $1\times10^4$, where G' (60) G' (80) are each a storage modulus of the toner at 60° C. and 80° C., respectively; G' (100)/G' (130) is from 1 to $10^2$, where G' (100) and G' (130) are each a storage modulus of the toner at 100° C. and 130° C., respectively; and G' (100-130) is from $5\times10^2$ to $1\times10^2$ dyn/cm$^2$, where G' (100-130) is a storage modulus of the toner at a temperature of from 100 to 130° C.

15 Claims, 2 Drawing Sheets

TONER FOR ELECTROPHOTOGRAPHY

This application is based on Japanese Patent Application No. 2007-256938 filed on Sep. 29, 2007, the entire content of which is hereby incorporated by reference.

TECHNICAL FIELD OF THE INVENTION

This invention is directed to a toner for electrophotography and an image forming method employing the toner.

BACKGROUND OF THE INVENTION

Recently speeding up of color image forming is demanded, and a color toner to obtain a color image with high speed stably is also demanded.

When an image is formed with high speed as low cost printing, running speed through a fixing nip portion in the fixing device is so short that pressure and heating energy to endow the toner is reduced, and glossiness is insufficient or uneven glossiness is generated and the obtained image is inferior to images by low cost printing.

Lower temperature fixing method has been investigated to reduce consumption energy by a fixing device which requires largest energy consumed in an electrophotographic image forming apparatus in view of energy saving program. Toner should melt at lower temperature to attain lower temperature fixing, and for this purpose it has been provided to reduce melt viscosity of toner by employing resin having low glass transition temperature or smaller molecular weight generally.

Toner of lower melt viscosity has large of toner viscoelasticity around fixing temperature, and therefore, there is a problem that image glossiness tends to be uneven or may causes irregular glossiness.

When a toner of lower melt viscosity is employed in a high speed image forming apparatus, running speed through a fixing nip portion in the fixing device is so short that pressure and heating energy to endow the toner is reduced, and glossiness is insufficient or uneven glossiness is generated and the obtained image is inferior to images by low cost printing.

Though an improving method in view of storage modulus of toner is provided, it has not become sufficient to satisfy the high demand of the market (Patent Documents 1 and 2).

Patent Document 1: JP A 2D06-084952

Patent Document 2: JP A 2006-133451

SUMMARY OF THE INVENTION

The present invention is to provide a toner for an electrophotography capable of low temperature fixing and forming a print image having high glossiness and minimized uneven glossiness.

A preferable embodiment of this invention will be described.

The toner of this invention meets requirements that;

G' (60)/G' (80) is from $1\times10^2$ to $1\times10^4$, where G' (60) and G' (80) are each a storage modulus of the toner at 60° C. and 80° C., respectively;

G' (100)/G' (130) is from 1 to $10^2$, where G' (100) and G' (130) are each a storage modulus of the toner at 100° C. and 130° C., respectively; and G' (100-130) is from $1\times10^2$ to $1\times10^5$ dyn/cm$^2$, where G' (100-130) is a storage modulus of the toner at a temperature of from 100 to 130° C.

The resin preferably comprises polycarboxylic acid component.

The toner preferably has a glass transition temperature of 20 to 45° C.

The toner of the present invention may be produced by an emulsion polymerization method. The toner is employed for forming a full color image advantageously.

The toner is advantageously employed as a developer in combination with a carrier having volume based average particle diameter (D4) of 25 to 60 μm.

The toner is advantageously applied for an electrophotographic image forming method whose printing speed is not less than 230 mm/sec.

DETAILED DESCRIPTION OF THE INVENTION

Figure 1:
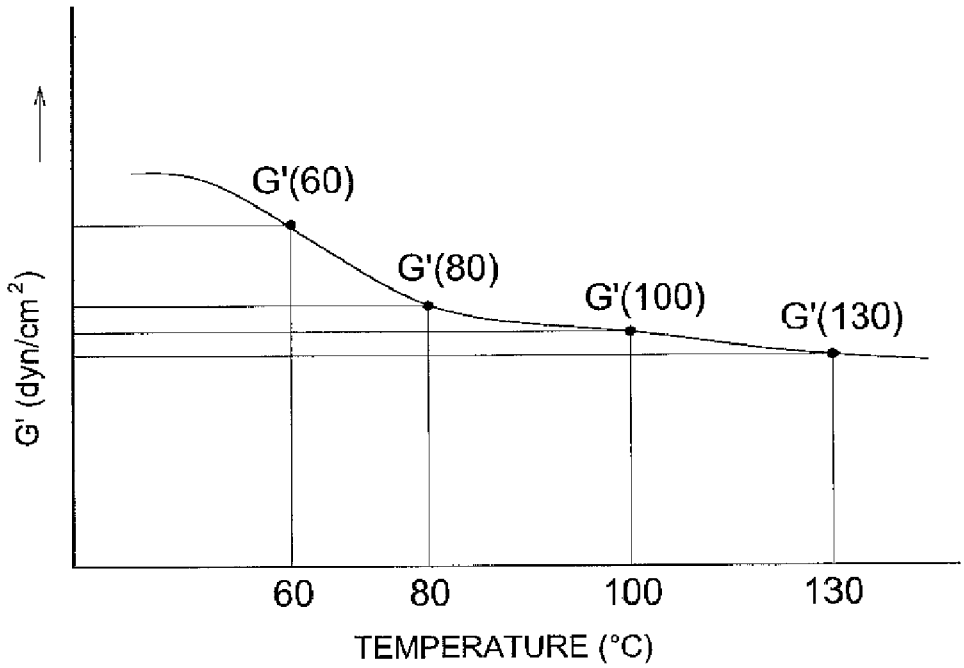
FIG. 1 is a graph showing a relation of storage modulus to temperature.

The problems may be dissolved by a toner having specific storage modulus even it is a low melt viscoelastic toner.

The toner meets the following requirements:

G' (60)/G' (80) is from $1\times10^2$ to $1\times10^4$, where G' (60) and G' (80) are each a storage modulus of the toner at 60° C. and 80° C., respectively;

G' (100)/G' (130) is from 1 to $10^2$, where G' (100) and G' (130) are each a storage modulus of the toner at 100° C. and 130° C., respectively; and G' (100-130) is from $1\times10^2$ to $1\times10^5$ dyn/cm$^2$, where G' (100-130) is a storage modulus of the toner at a temperature of from 100 to 130° C.

Storage Modulus

The value of G' (60)/G' (80) is a measure indicating fusibility necessary for low temperature fixing of a toner, where a greater value represents being more fusible even when fixed at low temperature.

The ratio of G' (60)/G' (80) is preferably in the range of $1\times10^2$ to $1\times10^4$ and more preferably $1\times10^3$ to $1\times10^4$.

The value of G' (100)/G' (130) is a measure representing a change in viscoelasticity at the time of low temperature fixing and a less value represents less change in viscoelasticity.

The ratio of G' (100)/G' (130) is 1 to $1\times10^2$, and preferably 1 to 30.

Thus, the value of G' (100)/G' (130) represents a region in which a binding resin melts and its storage modulus is lowered. A ratio of G' (100)/G' (130) being 1 means that the storage modulus is maintained without being lowered even at 120° C. and it is theoretically impossible for the value of G' (120) to exceed that of G' (100).

The value of G' (100-130) represents a value of storage modulus between 100 and 130° C.

A smaller G' (100-130) value represents higher melting property so as to obtain-high image glossiness.

The value G' (100-130) is $1\times10^2$ to $1\times10^5$ dyn/cm$^2$, preferably $5\times10^2$ to $5\times10^4$ dyn/cm$^2$.

The value G' (100) is preferably $1\times10^4$ to $1\times10^5$ dyn/cm$^2$, and the value G' (130) is preferably $5\times10^2$ to $5\times10^4$ dyn/cm$^2$.

Heretofore, it was difficult to achieve compatibility of G' at both a high temperature and a low temperature, for instance, when a value of G' (60)/G' (80) is increased to enhancement of fusibility, the condition G' (100-130) is satisfied but an increase of a value of G' (100)/G' (130) is accompanied, or inversely, when G' (100)/G' (130) is satisfied, the value of G' (60)/G' (80) is reduced and G' (100-130) is increased.

The invention is described more in detail.

In the invention, there was thus noted dynamic viscoelasticity of a toner and advantageous effects of the invention can be achieved by a toner exhibiting a storage modulus falling with a specific range at a specific temperature.

The dynamic viscoelasticity is to evaluate viscoelasticity of a sample by giving a sample strain or stress variable with time, such as sine oscillation and measuring stress or strain responsive thereto. Viscoelasticity obtained through sine oscillation is called dynamic viscoelasticity. In dynamic viscoelasticity, elastic modulus obtained through sine oscillation is represented in the form of a complex number.

Elastic modulus G is the ratio of stress σ applied to a sample to strain γ caused by the action of the stress σ and elastic modulus in dynamic viscoelasticity is called complex modulus G*. Thus, complex modulus G* in dynamic viscoelasticity is represented by stress σ* and strain γ*, as below:

$$G=\sigma^*/\gamma^*$$

The real part of complex modulus G* is called storage modulus and the imaginary part thereof is called loss modulus. There will be described below storage modulus as a factor specifying a toner used in the invention.

When a sinusoidal strain γ with an amplitude $\gamma_0$ and an angular frequency ω is given to a sample, the sinusoidal strain γ is represented as below.

$$\gamma=\gamma^0 \cos \omega t$$

Concurrently, a stress with an identical angular frequency results in the sample. Stress a propagates faster than strain γ by a phase δ and is represented as below:

$$\sigma=\sigma^0 \cos(\omega t+\delta)$$

Using the Euler formula, $$ei\omega t=\cos \omega t+i \sin \omega t$$

the foregoing equations are represented by complex number as below:

sinusoidal strain: $\gamma^*=\gamma^0\exp(i\omega t)$ and stress caused thereby: $\sigma^*=\sigma^0\exp[i(\omega t+\delta)]$ Substituting the foregoing formulas for $G^*=\sigma^*/\gamma^*$, $$G^*=(\sigma_0/\gamma_0)\exp \delta$$

$$=(\sigma_0/\sigma_0)(\cos \delta+i \sin \delta)$$

and G* is also represented as below:

$$G^*=G'+iG''$$

$$G'=(\sigma_0/\gamma_0)\cos \delta$$

$$G'=(\sigma_0/\gamma_0)\sin \delta$$

This means that the elastic energy accumulated in a viscoelastic body during one cycle is proportional to G' and an energy which the viscoelastic body loses as heat is proportional to G". Accordingly, G' as a real part is called the storage modulus, while G" as an imaginary part is called a loss modulus.

The storage modulus of a toner used in the invention can be determined by using a measurement apparatus according to the condition and procedure described below:

measurement instrument: MR-500 Soliquid Meter (produced by Rheology Co.)

frequency: 1 Hz measurement mode: temperature dispersion measurement jig: parallel plate of ϕ0.997 cm measurement procedure:

(1) A toner pellet having a diameter of 1 cm and height of 5-6 mm was prepared by employing compression molding apparatus for measurement sample.

(2) The toner pellet is then loaded onto a parallel plate installed in the measurement apparatus.

(3) After setting the measurement section temperature to a temperature of the softening point of the toner minus 15° C., the parallel plate-gap is adjusted to 3 mm.

(4) After cooled to the initial measurement temperature of 35° C., the measurement section is heated to 200° C. at a heating rate of 2° C./min to measure a storage modulus at a prescribed temperature with applying sinusoidal wave of 1 Hz. The strain angle was varied within the range of 0.02 to 5 deg. according to a torque.

Softening point temperature of the toner refers to that which is determined as follows. Namely, initially, under an ambience of 20° C. and 50% relative humidity, 1.1 g of a toner is placed in a Petri dish, flattened out, and allowed to stand for at least 12 hours. Thereafter, a 1 cm diameter cylindrical molded sample is prepared via application of a pressure of 3,820 kg/cm$^2$, employing molding machine "SSP-10A" (produced by Shimadzu Corp.). Subsequently, under an ambience of 24° C. and 50% relative humidity, by employing flow tester "CFT-500D" (produced by Shimadzu Corp.), the resulting sample is extruded from a cylindrical die hole (1 an diameter×1 mm) employing a 1 cm diameter piston after preheating under conditions of an applied load of 196 N (20 kgf), an initial temperature of 60° C., and a temperature raising rate of 6° C./minute, and offset method temperature $T_{offset}$ which is determined based on the fusion temperature determination method of the temperature raising method, which is set at an offset value of 5 mm, is designated as the softening point temperature of the toner.

FIG. 1 is a graph showing a relation of storage modulus to temperature.

The ordinate represents storage modulus and the abscissa temperature in the Figure.

There will be described toner constituting compounds.

A biding resin constituting the toner preferably comprises a resin (A) as a main component resin and a resin (B) as a sub-component resin containing a polycarboxylic acid component. The resin (B) containing a polycarboxylic acid component has higher glass transition temperature than that of the main component resin A). The toner as designed in such manner can form a print image having high glossiness and minimized uneven glossiness, since resin (A) attains low fixing temperature as well as viscoelasticity and intra cohesive strength of the toner are raised by introducing resin (B), whereby the resin (A) and carboxylic acid unit form hydrogen bonds locally.

Radical polymerization monomer having polycarboxylic acid component is considered to employ with the following advantage. The radical polymerization monomer having polycarboxylic acid component has strong polarity since the carboxylic acid is a functional group having very strong polarity, and there are two or more carboxylic acid in the polycarboxylic acid monomer. Consequently an affinity between the toner and a transfer material is guessed to be increased, and improvement of fixing strength is realized.

The polycarboxylic acid component is introduced in a polymer by polymerization of a polymerizable monomer having two or more carboxyl groups. Specific examples of such monomers include itaconic acid, maleic acid, fumaric acid, glutaconic acid, citraconic acid and mesaconic acid. Among them itaconic acid and maleic acid are preferable.

Resin (B) is preferably formed with vinyl polymer prepared by polymerization of radical polymerizable monomers containing a polycarboxylic acid component.

Content of the resin (B) in whole binding resin (sum amount of resin (A) and resin (B)) is preferably 3-30% by weight and more preferably 5-20% by weight.

Content of carboxylic acid component is 1-10% by weight and more preferably 2-6% by weight based on the toner.

The glass transition temperature of resin (A) is preferably 20-45° C., more narrowly 25-35° C., while the weight average molecular weight is preferably of 10,000-50,000, and more preferably 15,000-35,000.

Resin (A) preferably contains a releasing agent.

Proportion of radical polymerizable monomer component containing polycarboxylic acid component in the polymerizable monomer component forming resin (B) is 3-20% by weight and more preferably 5-10% by weight. The resin (B) preferably has a glass transition temperature of 40 to 70° C. and weight average molecular weight (Mw) of 50,000 to 200,000.

Viscoelasticity of resin composed of resin (A) and resin (B) can be controlled by selecting species and amount of the polycarboxylic acid in resin (B) and optimizing glass transition temperature and molecular weight.

Glass transition temperature of the toner is preferably 20-45° C. and more preferably 25-35° C.

Glass transition temperature of the toner mainly depends on glass transition temperature of resin (A) and resin (B) constituting toner.

Glass transition temperature can be measured by the following method.

The glass transition temperature of the toner can be measured by employing, for example, "DSC-7 DIFFERENTIAL CALORIMETER" (produced by Perkin Elmer Corp.) or "TAC7/DX THERMAL ANALYSIS UNIT CONTROLLER" (produced by Perkin Elmer Corp.).

In practice, about 4.5 to 5.0 mg of toner was collected and its weight was determined down to an accuracy of 0.01 mg. The resultant sample was sealed in an aluminum pan (KIT No. 0219-0041) and placed in a DSC-7 sample holder. An empty aluminum pan was employed for the reference measurement. The measurement was conducted with heat-cool-heat temperature control, in which the conditions are: a measurement temperature of 0-200° C., a temperature rising rate of 10° C./minute, and a temperature cooling rate of 10° C./minute, with temperature control of "Heat-Cool-Heat" mode, and analysis was carried out based on data during the 2nd heating.

The glass transition temperature is obtained as follows. An extension of the base line prior to elevation of the first endothermic peak and a tangential line, which exhibits the maximum inclination between the first peak elevation position and the peak top, are drawn and the resulting intersection is regarded as the glass transition temperature.

It is preferred that weight average molecular weight (Mw) of resin composing the toner is 10,000 to 100,000.

The molecular weight of resins can be determined by gel permeation chromatography (GPC) in the following method.

As the GPC method, a measurement sample is dissolved in tetrahydrofuran at a concentration of 1 mg/ml. Dissolution is conducted by using an ultrasonic homogenizer for 5 min. at room temperature. Subsequently, after treated in a membrane filter of 0.2 μm pore size, 10 μl of a sample solution was injected into the GPC. Condition of GPC measurement is described.

Apparatus: HLC-8220 (produced by TOSOH CORP.)

Column: TSK guard column+TSK gel Super HZM-M3 (produced by TOSOH CORP.)

Column temperature: 40° C.

Solvent: tetrahydrofuran

Flow rate: 0.2 ml/min

Detector: refractive index detector (RI detector) In the molecular weight measurement of a sample, the molecular weight distribution of the sample is calculated using a calibration curve prepared by using monodisperse polystyrene standard particles. Ten points are preferably used as polystyrene for the calibration curve.

Compounds constituting a toner (a polymerizable monomer, polycarboxylic acid, a colorant, a charge controlling agent, an external additive) are described.

There are usable monomers as polymerizable monomers forming the resin (A) and resin (B) constituting a binding resin. Specifically, a combination of styrene and acrylic acid or a combination of a methacrylic acid derivatives and a monomer having an ionically dissociative group is preferred.

Examples of such a monomer include styrene or its derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, and vinylidene fluoride; vinyl esters such as vinyl propionate, vinyl acetate, and vinyl benzoate; vinyl ethers such as vinyl methyl ether and vinyl ethyl ether; vinyl ketones such as vinyl methyl ketone, vinyl ethyl ketone, and vinyl hexyl ketone; N-vinyl compounds such as N-vinylcarbazole, N-vinylindole, and N-vinylpyrrolidone; vinyl compounds such as vinylnaphthalene and vinylpyridine; as well as derivatives of acrylic acid or methacrylic acid such as acrylonitrile, methacrylonitrile, and acryl amide. These vinyl based monomers may be employed individually or in combinations.

Further as polymerizable monomers, which constitute the resins, are preferably employed those having an ionic dissociating group in combination. Such monomers include, for example, those having substituents such as a carboxyl group, a sulfonic acid group, and a phosphoric acid group, as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, and 3-chloro-2-acid phosphoxypropyl methacrylate.

Further, it is feasible to prepare resins having a cross-linking structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

These polymerizable monomers may be polymerized by using radical polymerization initiators. In that case, oil-soluble polymerization initiators are used in suspension polymerization. Examples of an oil-soluble polymerization initiator include azo- or diazo-type polymerization initiators, e.g. 2,2'-azobis-(2,4-dimethylvaleronitrile), 2,2'-azobisisobutylonitrile, 1,1'-azobis (cyclohexane-1-carbonitrile), 2,2'-azobis-4-methoxy-2,4-dimethylvaleronitrile, azobisisobutylonitrile; peroxide type polymerization initiators, e.g., benzoyl peroxide, methyl ethyl ketone peroxide, diisopropylperoxycarbonate, cumene hydroperoxide, t-butyl hyroperoxide, di-t-butyl peroxide, dicumyl peroxide, 2,4-dichlorobenzoyl peroxide, lauroyl peroxide, 2,2-bis-(4,4-t-butylperoxycyclohexyl)-propane, tris-(t-butylperoxy) triazine; and polymeric initiators having a side-chain of peroxide.

Water-soluble radical polymerization initiators are usable when forming particulate resin through emulsion polymerization. Examples of a water-soluble polymerization initiator include persulfates such as potassium persulfate and ammonium persulfate; azobisaminodipropane acetic acid salt, azobiscyanovaleric acid and its salt, and hydrogen peroxide.

Polycarboxylic Acid

The above described polycarboxylic acid compounds may be employed.

(Colorant)

Inorganic or organic colorants are usable for the toner. Specific colorants are as follows.

Examples of black colorants include carbon black such as Furnace Black, Channel Black, Acetylene Black, Thermal Black and Lamp Black and magnetic powder such as magnetite and ferrite.

Magenta and red colorants include C.I. Pigment Red 2, C.I. Pigment Red 3, C.I. Pigment Red 5, Pigment Red 6, Pigment Red 7, Pigment Red 15, C.I. Pigment Red 16, C.I. Pigment Red 48, C.I. Pigment Red 53, C.I. Pigment Red 57, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Orange or yellow colorants include C.I. Pigment orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 74, C.I. Pigment Yellow 93, C.I. Pigment Yellow 94, C.I. and Pigment Yellow 138.

Green or cyan colorants include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66 and C.I. Pigment Green 7.

The foregoing colorants may be used alone or in combination. The colorant content is preferably from 1% to 30% by mass, and more preferably 2% to 20% by mass.

Releasing Agent

Waxes are usable in the toner of the invention.

Examples thereof include polyolefin wax such as polyethylene wax and polypropylene wax; long chain hydrocarbon wax such as paraffin wax and Sasol wax; dialkylketone type wax such as distearylketone; ester type wax such as carnauba wax, montan wax, trimethylolpropane tribehenate, pentaerythritol tetrabehenate, pentaerythritol diacetate dibehenate, glycerin tribehenate, 1,18-octadecanediol distearate, trimellitic acid tristearate, and distearyl meleate; and amide type wax such as ethylenediamine dibehenylamide and trimellitic acid tristearylamide.

The releasing agent content of the toner is preferably in the range of 1 to 20% by mass, and more preferably 3 to 15% by mass.

Charge Controlling Agent

The toner of the invention may optionally contain a charge controlling agent. Charge controlling agents usable in the invention include various compounds.

External Additive

To improve flowability or charging property or to enhance cleaning capability, so-called external additives may be added to the toner. External additives are not specifically limited and a variety of inorganic particles, organic particles and sliding agents are usable as an external additive.

Inorganic oxide particles of silica, titania, alumina and the like are preferably used for inorganic particles. The inorganic particles may be surface-treated preferably by using a silane coupling agent, titanium coupling agent and the like to enhance hydrophobicity. Spherical organic particles having an average primary particle size of 10 to 2,000 nm are also usable. Polystyrene, poly(methyl methacrylate), styrene-methyl methacrylate copolymer and the like are usable as organic particles.

External additives ate incorporated to the toner preferably in an amount of 0.1-0.5% by mass, and more preferably 0.5-4.0% by mass. External additives may be incorporated alone or in combination.

Manufacturing method of toner is described.

Manufacture of Toner

Methods for manufacturing the toner are not specifically limited and examples thereof include an emulsion coagulation polymerization method, a mini-emulsion coagulation polymerization method, a suspension polymerization method, a dispersion polymerization method, a solution suspension method, a melting method and a kneading pulverization method. Of these methods, a mini-emulsion coagulation method and an emulsion coagulation polymerization method are preferable in terms that adjustment of viscoelasticity by the main component resin (A) and the sub-component resin (B) is easily controlled.

Toners used in this invention are manufactured, for instance, via the steps comprising:

(1) monomer solution preparation step of obtaining a radical polymerizable monomer, by dissolving a releasing agent therein, if necessary, (2) polymerization step in which the radical polymerizable monomer solution is made droplets in an aqueous medium and polymerized by mini-emulsion polymerization to prepare a dispersion of binder resin particles, (3) coagulation/fusion step of allowing resin particle and other minute particles of other component such as colorant particles to coagulate and fuse to form coalesced particles (4) coagulation step of ripening the coalesced particles with heat energy to adjust its shape, and obtaining toner mother particles, (5) cooling step of cooling a dispersion of the toner mother particles, (6) washing step of separating the toner mother particles from a cooled dispersion of the toner mother particles to remove surfactants and the like from the toner mother particles;

(7) drying step of drying the washed toner mother particles, and (8) a step of adding external additives to the dried toner mother particles.

The resin (B) may be introduced to resin (A) in the following method (I) or (II) in the manufacturing method of toner having a binder resin (resin (A) and resin (B)) by mini-emulsion polymerization coagulation method.

(I) A method introducing in the step (2) as described above.

Specifically this includes the methods (I-a), (I-b) and (I-a): A method introducing resin (B) into resin (A) by adding minute particles of preliminary polymerized resin (B) into oil droplets of radical polymerizable monomer solution for forming resin (A) during the polymerization step (2) described above.

(I-b): A method by making oil droplets of radical polymerizable monomer solution for forming resin (B) in an aqueous medium and conducting mini-emulsion polymerization to prepare minute particles of resin (B), and then conducting emulsion polymerization of radical polymerizable monomer for forming resin (A) during the polymerization step (2) described above.

(I-c): A method emulsion polymerization (multi-stage polymerization) is conducted by employing radical polymerizable monomer solution for forming resin (B) after mini-emulsion polymerization of resin (A), during the polymerization step (2) described above.

(II) A method introducing in the step (3) as described above.

Specifically this includes the methods (II-a) and (II-b).

(II-a): A method adding minute particles of resin (A) and minute particles of resin (B) simultaneously and coagulating these during coagulation/fusion step (3) described above.

(II-b): A method adding minute particles of resin (B) after starting the coagulation of minute particles of resin (A) and before completion of coagulation of minute particles of resin (A) and conducting coagulation during coagulation/fusion step (3) described above.

A method of (I-a) is preferable

The aqueous medium refers to a medium that is composed mainly of water (at 50% by mass or more). A component other than water is a water-soluble organic solvent. Examples thereof include methanol, ethanol, isopropanol, butanol, acetone, methyl ethyl ketone and tetrahydrofuran. Of these solvents, alcoholic organic solvents such as methanol, ethanol, isopropanol and butanol are specifically preferred.

There will be further described the individual steps (1) through (8).

(1) Monomer Solution Preparation Step:

This step comprises dissolving, if necessary, a releasing agent in a polymerizable monomer to form a polymerizable monomer solution.

(2) Polymerization Step:

In one suitable embodiment of the polymerization step, the foregoing polymerizable monomer solution is added to an aqueous medium and mechanical energy is applied thereto to form oil-droplets, subsequently, polymerization is performed in the interior of the oil-droplets by radicals produced from a water-soluble polymerization initiator. Resin particles as nucleus particles may be added to the aqueous medium in advance.

Resin particles containing a binding resin (and a releasing agent) are obtained in the polymerization step. The obtained binding resin particles may or may not be colored. The colored binding resin particles can be obtained by subjecting a monomer composition containing a colorant to polymerization. In cases when using non-colored binding resin particles, a dispersion of colorant microparticles is added to a dispersion of binding resin particles, and the colorant particles and the binding resin particles are coagulated to obtain toner mother particles.

(3) Coagulation/Fusion Step:

In the coagulation/fusion step, in cases when the binding resin particles are non-colored, a dispersion of colorant microparticles is added to the dispersion of binding resin particles, obtained in the foregoing polymerization step, and allowing the binding resin particles to be salted outs coagulated and fused with the colorant microparticles. In the coagulation/fusion step, particles of internal additives such as a charge-controlling agent may be coagulated together with binding resin particles and colorant microparticles.

A dispersion of colorant microparticles can be prepared by dispersing colorant microparticles in an aqueous medium. Dispersing colorant microparticle is performed at a surfactant concentration in water higher than the critical micelle concentration (CMC). Dispersing machines used for dispersing colorant microparticles are not specifically limited but preferred examples thereof include pressure dispersing machines such as an ultrasonic disperser, a mechanical homogenizer, a Manton-Gaurin homomixer or a pressure homogenizer, and a medium type dispersing machines such as a sand grinder, a Getzman mill or a diamond fine mill.

The colorant particles may be those which have been subjected to surface modification treatments. Surface modification of the colorant particles is affected, for example, in the following manner. A colorant is dispersed in a solvent and thereto, a surface-modifying agent is added and allowed to react with heating. After completion of the reaction, the colorant is filtered off, washed with the same solvent and dried to produce a surface-modified colorant (pigment).

The preferable coagulation method is that a salting-out agent composed of an alkali metal salt, alkali earth metal salt and the like is added at a concentration not less than critical coagulation concentration for coagulation is added to an aqueous medium containing resin particles and colorant microparticles and coagulation is undergone at a temperature of the resin's glass transition temperature of or higher.

(4) Ripening Step:

Ripening is performed preferably by using thermal energy (heating).

Specifically, a system including coagulated particles is stirred with heating, while controlling the heating temperature, a stirring speed and heating rate until the shape of toner particles reaches the intended average circularity.

(5) Cooling Step:

This step refers to a stage that subjects a dispersion of the foregoing toner particles to a cooling treatment (rapid cooling). Cooling is performed at a cooling rate of 1 to 20° C./min. The cooling treatment is not specifically limited and examples thereof include a method in which a refrigerant is introduced from the exterior of the reaction vessel to perform cooling and a method in which chilled water is directly supplied to the reaction system to perform cooling.

(6) Washing Step:

In the washing step, a solid-liquid separation treatment of separating toner particles from a toner particle dispersion is conducted, then cooled to the prescribed temperature in the foregoing step and a washing treatment for removing adhered material such as a surfactant or salting-out agent from a separated toner particles (aggregate in a cake form) is applied.

In this step, washing is conducted until the filtrate reaches a conductivity of 10 μS/cm. A filtration treatment is conducted, for example, by a centrifugal separation, filtration under reduced pressure using a Buchner's funnel or filtration using a filter press, but the treatment is not specifically limited.

(7) Drying;

In this step, the washed toner cake is subjected to a drying treatment to obtain dried colored particles. Drying machines usable in this step include, for example, a spray dryer, a vacuum freeze-drying machine, or a vacuum dryer. Preferably used are a standing plate type dryer, a movable plate type dryer, a fluidized-bed dryer, a rotary dryer or a stirring dryer.

The moisture content of the dried toner particles is preferably not more than 5% by mass, and more preferably not more than 2%. When toner particles that were subjected to a drying treatment are aggregated via a weak attractive force between particles, the aggregate may be subjected to a pulverization treatment. Pulverization can be conducted using a mechanical pulverizing device such as a jet mill, Henschel mixer, coffee mill or food processor.

(8) External Additive Addition:

In this step, the dried colored particles are optionally mixed with external additives to prepare a toner.

There are usable mechanical mixers such as a Henschel mixer and a coffee mill.

Developer is described.

Developer

The toner may be used as a toner used for a single-component developer, or a two-component developer.

The toner may be used as a non-magnetic single component developer as itself, or a magnetic single component developer in which magnetic powder having particle size of 0.1 to 0.5 μm is incorporated in the toner particles.

The toner may be used as a two-component developer, in which the toner is mixed with a carrier. Magnetic particles, for example, metals such as iron, ferrite or magnetite and alloys of these metals and aluminum or lead are usable as a carrier, and ferrite particles are specifically preferred.

There may also be used as a coat carrier in which the magnetic particle surface is coated with a covering agent or a dispersion type carrier obtained by dispersing powdery magnetic material in a binder resin. Example of the resin used for coating carrier includes olefin resin, styrene resin, styrene-acryl resin, silicon resin, ester resin and fluorine containing resin. Example of the resin used for dispersing magnetic powder includes styrene-acryl resin, polyester resin, fluorine resin, and phenol resin. The coated carrier coated with styrene-acryl resin is preferable as it inhibits release of external additives or maintains durability.

The volume based average particle diameter (D4) of a carrier is preferably 25 to 60 μm, and more preferably 25 to 40 μm. The volume-average particle size of the carrier can be determined using a laser diffraction type particle size distribution measurement apparatus provided with a wet disperser, HELOS (produced by SYMPATEC Corp.).

The image forming method and the image forming apparatus are described.

The toner of this invention is advantageously employed for an image forming method in which the toner is installed in an apparatus having a contact heating fixing device suitable for low temperature fixing.

Image Forming Apparatus

The image forming apparatus to which this invention is applicable includes monochrome image forming apparatus with monotone developer, a color image forming apparatus in which toner images on a photoreceptor(s) are transferred to an intermediate transfer material in sequence, and a tandem type color image forming apparatus having a plural photoreceptor in each color arranged on an intermediate transfer material in series.

Figure 2:
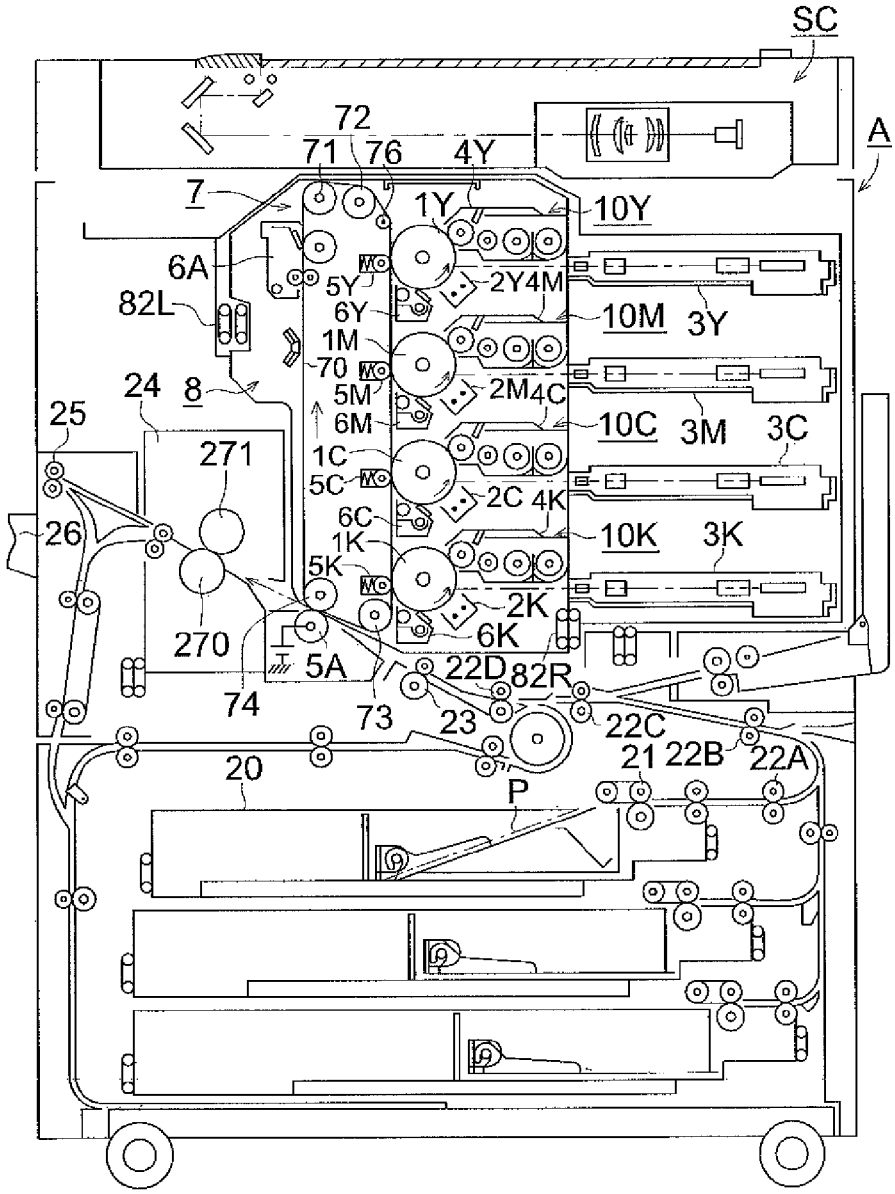
FIG. 2 is a schematic view of an image forming apparatus in which the toner of this invention may be applied.

FIG. 2 is a schematic view of an example of an apparatus to which the image forming method using the toner can be applied.

The symbols 1Y, 1M, 1C and 1K are each a photoreceptor, 4Y, 4M, 4C and 4K are each a developing member, 5Y, 5M, 5C and 5K are each a first transfer roller, 5A is a second transfer roller, 6Y, 6M, 6C and 6K are each a cleaning member, 7 is an intermediate transfer material unit, and 70 is an intermediate transfer member, in FIG. 2.

The image forming apparatus is one so called a tandem type color image forming apparatus, in which plural image forming members 10Y, 10M, 10C and 10Bk, an endless belt-shaped intermediate transferring unit 7 as a transfer member, an endless belt shaped paper supplying and conveying member 21 which conveys a recording material P and a thermal roller fixing device 24 as a fixing member are equipped. An original image reading device SC is arranged at the upper portion of the main body A of the image forming apparatus.

The image forming unit 10Y for forming a yellow colored image, which is an example of color toner image on each photoreceptor, has a drum-shaped photoreceptor 1Y, and a charging member 2Y arranged around the photoreceptor 1Y, an exposing member 3Y, a developing member 4Y, a primary transferring roller 5Y and a cleaning member 6Y, which are arranged around the photoreceptor 1Y. The image forming unit 10M for forming a magenta colored image has a drum-shaped photoreceptor 1M, and a charging member 2M arranged around the photoreceptor 1M, an exposing member 3M, a developing member 4M, a primary transferring roller 5M and a cleaning member 6M, which are arranged around the photoreceptor 1M. The image forming unit 10C for forming a cyan colored image has a drum-shaped photoreceptor 1C, and a charging member 2C arranged around the photoreceptor 1C, an exposing member 3C, a developing member 4C, a primary transferring roller 5C and a cleaning member 6C, which are arranged around the photoreceptor 1C. The image forming unit 10K for forming a magenta colored image has a drum-shaped photoreceptor 1K, and a charging member 2K arranged around the photoreceptor 1K, an exposing member 3K, a developing member 4K, a primary transferring roller 5K and a cleaning member 6K, which are arranged around the photoreceptor 1K.

The endless belt-shaped intermediate transferring unit 7 has an endless belt-shaped intermediate transfer member 70 which is wound on plural rollers and circulatably held.

Each toner image formed in the image forming units 10Y, 10M, 10C and 10K, respectively, is successively transferred onto the circulating endless belt-shaped intermediate transfer member 70 by the primary transferring rollers 5Y, 5M, 5C and 5Bk, thus a color image is synthesized. Paper P as a recording material stocked in a paper supplying cassette 20 is supplied and conveyed by a paper supplying and conveying member 21, to a secondary transferring roller 5A as a secondary transfer member through plural intermediate conveying rollers 22A, 22B, 22C and 22D and a register roller 23. Then the color image is collectively transferred by the secondary transfer member onto the paper P. The color image transferred on the paper P is fixed by the fixing member 24 and conveyed by an output roller 25 to be stood on an output tray 26.

In one example of fixing conditions of the fixing device, the fixing temperature (the surface temperature of the heating roller 271 is 70 to 180° C. (preferably 70 to 150° C.) and the fixing linear speed is 80 to 640 mm/sec (preferably, not less than 230 mm/sec. Print speed is determined by the speed of fixing.

The toner remained on the endless belt intermediate transfer member 70 is removed by the cleaning member 6A after the color image is transferred to the paper P by the secondary transferring roller 5A and the paper P is separated by curvature from the intermediate transferring belt.

The primary transferring roller 5K is constantly pressed to the photoreceptor 1Bk in the course of image formation process. The other primary transferring rollers 5Y, 5M and 5C are each contacted by pressing to the corresponding photoredeptors 1Y, 1M and 1C, respectively, only for the period of image formation.

The secondary transferring roller 5A is contacted by pressing to the endless belt shaped intermediate transfer member 70 only for the period of the secondary transferring while passing of the paper P.

A frame 8 can be pulled out from the main body A of the apparatus through supporting rails 82L and 82R.

The frame a includes the image forming units 10Y, 10M, 10C and 10K, and an intermediate transferring unit 7.

The image forming units 10Y, 10M, 10C and 10K are serially arranged in the perpendicular direction. In the drawing, the endless belt-shaped intermediate transferring unit 7 is arranged at left side of the photoreceptors 1Y, 1M, 1C and 1K. The endless belt-shaped intermediate transferring unit 7 included the circulatable endless belt-shaped intermediate transfer member 70 wound with the rollers 71, 72, 73, 74 and 76 the primary transferring rollers 5Y, 5M, 5C and 5K and the cleaning member 6A.

The image forming units 10Y, 10M, 10C and 10K can be pulled out from the main body A together with the endless belt-shaped intermediate transferring unit 7 when the frame 8 is pulled out.

As above-mentioned, toner images are each formed on the photoreceptors 1Y, 1M, 1C and 1K and accumulated on the endless belt-shaped intermediate transfer member 70, and then collectively transferred onto the recording medium P and fixed by heating and pressing between a pressure roll 270 and a heating roller 271 of heat roll fixing device 24. The photoreceptors 1Y, 1M, 1C and 1K are subjected to cleaning by removing the toner remaining thereon by the cleaning member 6A. After that, the Image formation is repeated by the next cycle of the charging, exposing and developing.

Transfer Material

Transfer material used in this invention is a support to carry toner image, and is usually called as an image support material, a transfer material or transfer paper. Specifically it includes usual paper having various thickness, coated printing paper such as art paper or coated paper, Japanese paper or post card on the market, plastic film such as OHP sheet and textile The present invention will now be specifically described referring to examples.

Preparation of Toner

Toners were prepared in the following manner.

Preparation of Toner Mother Particles 1-9

Preparation of Resin Particles A1

Dispersion of Resin Particles A1 was prepared in the following manner (1) First Step Polymerization The following compounds were charged, and mixed in a reaction vessel on which a stirrer, thermal sensor, cooling tube and nitrogen introducing device were attached, and dissolved by heating at 80° C. to prepare a monomer mixture solution 1.

| Monomer Mixture Solution 1 | |
|---|---|
| Styrene | 91 parts by weight |
| n-Butyl acrylate | 73 parts by weight |
| Methacrylic acid | 12 parts by weight |
| n-Octyl mercaptan | 2 parts by weight |
| Paraffin wax HNP-57, manufactured by Nippon Seiro Co., Ltd. | 94 parts by weight |

A surfactant solution was prepared by dissolving 1.5 parts by weight of sodium polyoxyethylene(2)dodecylether-Sulfate in 650 parts by weight of deionized water. The surfactant solution was heated by 90° C.

The Monomer Mixture Solution 1 was poured into the surfactant solution, and the polymerizable monomer solution was dispersed for 2 hours by a mechanical disperser having a circulation pass, CLEARMIX manufactured by M-Technique Co, Ltd., to prepare a dispersion of emulsified particles having an average particle diameter of 210 nm for 3 hours dispersion process. Deionized water in an amount of 700 g heated at 90° C. was added thereto.

An initiator solution prepared by dissolving 3 parts by weight of potassium persulfate, KPS in 120 parts by weight of deionized water was added and the temperature was adjusted to 82° C. Polymerization (first step of polymerization) was performed by heating and stirring the system for 3 hours to prepare resin particles which were referred to as Dispersion of Resin Particles A1.

(2) Second Step Polymerization (Formation of Outer Layer)

To the Dispersion of Resin Particles A1, an initiator solution prepared by dissolving 3 parts by weight of potassium persulfate in 120 parts by weight of deionized water was added and a monomer mixture composed of the following Monomer Mixture Solution 2 was dropped spending 1 hour under a temperature condition of 80° C.

| Monomer Mixture Solution 2 | |
|---|---|
| Styrene | 183 parts by weight |
| n-Butyl acrylate | 112 parts by weight |
| Methacrylic acid | 3 parts by weight |
| n-Octylmercaptan | 5 parts by weight |

After completion of the dropping, the system was heated and stirred for 3 hours for carrying out polymerization (the second step of polymerization). And then the system was cooled by 28° C. to obtain Dispersion of Resin Particles A1 having two layer structure. Resin Particles A1 composing the Dispersion of Resin Particles A1 has a glass transition temperature (Tg) of 21° C.

Preparation of Dispersion of Resin Particles A2 through A6

Dispersion of Resin Particles A2 through A6 were prepared in the same manner as in the Dispersion of Resin Particles A1, except that amounts of the monomers and initiators used in the first and the second step polymerization as shown in Table 1. Weight average molecular weigh Mw and glass-transition temperature of the prepared Resin Particles A1 through A6 are shown in Table 1.

TABLE 1

| | First step | | | | Second step | | | | | |
|---|---|---|---|---|---|---|---|---|---|---|
| Resin particle A | St (*1) | n-BAc (*2) | MA (*3) | n-Octyl mercaptan | St (*1) | n-BAc (*2) | MA (*3) | n-Octyl mercaptan | Mw | Tg(° C.) |
| A1 | 91 | 73 | 12 | 2 | 183 | 112 | 3 | 5 | 19,800 | 21 |
| A2 | 103 | 62 | 12 | 2 | 195 | 103 | 0 | 7 | 25,000 | 28 |

TABLE 1-continued

| Resin particle A | First step St (*1) | First step n-BAc (*2) | First step MA (*3) | First step n-Octyl mercaptan | Second step St (*1) | Second step n-BAc (*2) | Second step MA (*3) | Second step n-Octyl mercaptan | Mw | Tg(° C.) |
|---|---|---|---|---|---|---|---|---|---|---|
| A3 | 102 | 62 | 12 | 3 | 210 | 88 | 0 | 2 | 26,800 | 32 |
| A4 | 115 | 49 | 12 | 3 | 222 | 76 | 0 | 2 | 24,300 | 42 |
| A5 | 91 | 73 | 12 | 3 | 183 | 112 | 3 | 6 | 18,500 | 18 |
| A6 | 102 | 62 | 12 | 3 | 201 | 97 | 0 | 3 | 22,500 | 31 |
| A7 | 123 | 41 | 12 | 5 | 195 | 103 | 0 | 4 | 18,200 | 52 |

(*1) St: Styrene,
(*2) n-BAc: n-Butyl acrylate,
(*3) MA: Methacrylic acid

Preparation of Resin Particles B1

Dispersion of Resin Particles B1 was prepared in the following manner.

Surfactant solution preliminary dissolving 0.34 parts by weight of anionic surfactant sodium dodecylbenzene sulfonate (SDS) in 350 parts by weight of water was poured into a reaction vessel on which a stirrer, thermal sensor, cooling tube and nitrogen introducing device were attached, inside temperature was heated up to 80° C. with stirring at 230 rpm under nitrogen gas stream.

A monomer solution was prepared by mixing and dissolving with heating up to 78° C.

| | |
|---|---|
| Styrene | 5 parts by weight |
| Methyl methacrylate | 71 parts by weight |
| n-Butyl acrylate | 19 parts by weight |
| Itaconic acid | 5 parts by weight |
| n-Octyl mercaptan | 14 parts by weight |

The monomer solution was added to the surfactant solution and dispersed for 2 hours by a mechanical disperser having a circulation pass, CLEARMIX manufactured by M-Technique Co, Ltd., to prepare a dispersion of emulsified particles having uniform particle diameter. An initiator solution prepared by dissolving 1.38 parts by weight of potassium persulfate, KPS, in 80 parts by weight of deionized water was added and heated and agitated at 82° C. to obtain Dispersion of Resin Particles B1

Weight average molecular weight Mw and a glass transition temperature Tg of Resin Particles B1 composing the Dispersion of Resin Particles B1 were 15,000 and 60° C., respectively.

Preparation of Resin Particles B2

Dispersion of Resin Particles B1 was prepared in the same manner as the Preparation of Resin Particles B1 except that species and content ratio of the monomers were changed as shown in Table 2.

Each of monomer content, weight average molecular weight Mw and a glass transition temperature Tg of Resin Particles B1 and B2 were shown in Table 2.

TABLE 2

| Resin particle B | Styrene | Methacrylic acid | n-Butyl acrylate | Itaconic acid | Mw | Tg (° C.) |
|---|---|---|---|---|---|---|
| B1 | 5 | 71 | 19 | 5 | 15,000 | 60 |
| B2 | 3 | 62 | 28 | 7 | 24,000 | 40 |

Preparation of Colorant Dispersion C1

Sodium dodecylsulfate in an amount of 90 parts by weight were added to 1,600 parts by weight of deionized water and were mixed. To the mixture was gradually added while stirring and dispersed by a stirring apparatus CLEARMIX, manufactured by M-Technique Co., Ltd., to prepare a dispersion of the colorant particles. The average dispersed particle diameter of the colorant particles in the dispersion measured by a dynamic light scattering particle size analyzer MICROTRAC UPA150, manufactured by Nikkiso Co., Ltd., was 150 nm.

Preparation of Toner Mother Particles 1

To a vessel fitted with a stirrer, a temperature sensor, a condenser and a nitrogen gas introducing device was placed Dispersion of Resin Particles A1 at a solid content of 360 parts by weight, 40 parts by weight of Dispersion of Resin Particles B1 at a solid content, 1100 g of deionized water, and 200 parts by weight of colorant dispersion C1 were added temperature was adjusted to 30° C., then pH was added to 10.0 by adding 5N aqueous sodium hydroxide solution. Subsequently, an aqueous solution of 60 parts by weight of magnesium chloride dissolved in 60 parts by weight of deionized water was added thereto at 30° C. over 10 min. with stirring. After being maintained for 3 min., the temperature was raised to 80° C. over 60 min. and maintained at 80° C. to promote particle growth reaction. While measuring coagulated particle sizes using COULTER MULTISIZER III and when reached a volume-based median diameter ($D_{50}$) of 6.0 μm.

When reached the intended particle size, an aqueous solution of 190 parts by weight of sodium chloride dissolved in 760 ml parts by weight of deionized water was added thereto to terminate particle growth. Further, ripening was performed at 80° C. with stirring to promote fusion between particles until reached an average circularity of 0.965. Then, cooling was conducted until reached 30° C. and stirring was terminated.

The fused particles thus prepared were subjected to filtration, washing with deionized water, then transferred to Flash Jet Dryer (produced by Seishin Enterprise Co., Ltd.) and dried until reached a moisture content of 1.0% by mass to obtain Toner Mother particles 1. A volume-based median diameter ($D_{50}$) of the obtained Toner Mother particles 1 was 6 μm.

Preparation of Toner Mother Particles 2-9

Toner Mother Particles 2-9 were prepared in the same manner as Toner Mother Particles 1 except that species and content of Resin Particles A and Resin Particles B was changed as shown in Table 3.

Preparation of Toner 1-9

Toner 1-9 were prepared by adding 3.5 parts by weigh of hydrophobic silica microparticles having number average primary particle diameter of 80 nm, 0.6 parts by weigh of hydrophobic titania microparticles having number average primary particle diameter of 10 nm were added to each of 100 parts by weight of Toner Mother Particles 1-9, and they were mixed for 25 minutes with circumferential speed of 35 m/sec, by HENSCHEL mixer (by Mitsui Miike Kakoki Co.). Volume based median particle diameter ($D_{50}$) of each toner Particles 1-9 was same as those of Toner Mother Particles 1-9.

Species, content of Resin A and Resin B used for the toners, volume based median particle diameter ($D_{50}$) Tg and storage modulus of the toners are shown in Table 3. Storage modulus decreases according to increasing temperature, and therefore G' (100) is largest and G' (130) in the temperature range from 100-130° C., and maximum and minimum values of G' (100-130) are G' (100) and G' (130), respectively, in each toner.

TABLE 3

| Toner | Resin A | Resin B | Content of Resin B (% by weight) | D50 (μm) | Tg (° C.) | G'(60) dyn/cm$^2$ | G'(80) dyn/cm$^2$ | G'(60)/G'(80) | G'(100)/G'(130) | G'(100-130) G'(100) (dyn/cm$^2$) | G'(100-130) G'(130) (dyn/cm$^2$) |
|---|---|---|---|---|---|---|---|---|---|---|---|
| Toner 1 | A4 | B2 | 10 | 6 | 44 | $9.05 \times 10^8$ | $8.70 \times 10^6$ | 104 | 4 | 100,000 | 25,000 |
| Toner 2 | A3 | B2 | 10 | 6 | 33 | $9.80 \times 10^7$ | $9.80 \times 10^4$ | 1,000 | 10 | 51,000 | 5,100 |
| Toner 3 | A2 | B2 | 10 | 6 | 30 | $1.60 \times 10^9$ | $2.90 \times 10^5$ | 5,500 | 20 | 40,000 | 2,000 |
| Toner 4 | A1 | B2 | 10 | 6 | 24 | $6.47 \times 10^8$ | $6.60 \times 10^4$ | 9,800 | 100 | 50,000 | 500 |
| Toner 5 | A1 | B2 | 30 | 6 | 24 | $2.93 \times 10^8$ | $4.50 \times 10^4$ | 6,500 | 30 | 15,000 | 500 |
| Toner 6 | A4 | B1 | 5 | 6 | 43 | $7.59 \times 10^7$ | $6.90 \times 10^5$ | 110 | 7 | 49,000 | 7,000 |
| Toner 7 | A6 | B2 | 10 | 6 | 52 | $4.95 \times 10^9$ | $9.00 \times 10^7$ | 55 | 1.4 | 210,000 | 150,000 |
| Toner 8 | A5 | B2 | 10 | 6 | 19 | $3.80 \times 10^7$ | $2.00 \times 10^3$ | 19,000 | 200 | 500 | 2.5 |
| Toner 9 | A4 | B1 | 20 | 6 | 42 | $6.43 \times 10^9$ | $6.30 \times 10^7$ | 102 | 3 | 150,000 | 50,000 |

Storage modulus was measured by a method described above, employing MR-500 Soliquid Meter.

Preparation of Developer

Developers 1-9 were prepared by adding silicon resin coated ferrite carrier having volume based average diameter (D4) of 60 μm so as to have toner content of 6% by weight.

Evaluation

Practical Printing

Monocolor by cyan toner printing was conducted by employing "Bizhub PRO C500" (manufactured by Konica Minolta Business Technologies Inc.) modified so that fixing speed and fixing temperature of heating roller could be variable. Specification of a fixing device is described below.

Fixing speed: 280 mm/sec

Surface material of heating roller: PTFE

Tee evaluation was conducted by employing toners prepared above in sequence under the circumstances of 20° C. and 50% RH.

Solid monocolor cyan image having 2 cm×5 cm, printed toner amount of 12.5 g/m$^2$, was printed on A4 size high quality paper (64 g/m$^2$)

Lowest Fixing Temperature

Lowest temperature acceptable fixing property was evaluated Test images were printed by changing surface temperature of heating roller at every 5° C. Fixing ratio of each sample was measured by peeling method employing a mending tape. Test sample having fixing ratio of not less than 80% was acceptable. The measuring method is described.

(1) Absolute reflectance density D0 of the solid image was measured.

(2) Mending Tape (No. 810-3-12, manufactured by Sumitomo 3M Ltd.) was softly adhered to the solid image.

(3) Tape was rubbed with pressure of 1 kPa for 3.5 times.

(4) Tape is peeled at an angle of 180 degree with force of 200 g.

(5) Absolute reflectance density D1 of the solid image after peeling was measured.

(6) Fixing ratio was calculated by a formula $$\text{Fixing ratio (\%)} = D1/D0 \times 100$$

Reflective Densitometer RD-91, manufactured Macbeth Co. was employed for measurement of image density.

The sample having lowest temperature acceptable fixing property being 115° C. or less is practically acceptable.

Uneven Glossiness

A solid image having printed toner amount of 12.5 g/m$^2$ was printed with fixing temperature at 20° C. higher than the acceptable lowest fixing temperature. Glossiness of the solid image was measured by a glossimeter GMX-203, manufactured by Murakami Color Research Laboratory Co., Ltd., selecting 75° measuring angle in accordance with JIS Z 8741.

Uneven glossiness was measure by difference of gloss at five points, four corners and center of the solid image. Criteria is.

A: Gloss difference of not more than 6

B: Gloss difference of more than 6 and not more than 14

C: Gloss difference of more than 14

Glossiness

Glossiness of the printed image was measured by a glossimeter GMX-203, manufactured by Murakami Color Research Laboratory Co., Ltd., selecting 75° measuring angle in accordance with JIS Z 8741 Glossiness is an average value measured at five points, four corners and center of the solid image.

Criteria is,

A: High glossy range of not less than 27

B: semi-glossy range of 17 to less than 27

C: Low glossy range less than 17

Evaluation ranks "A" and "B" are practically acceptable. Rank "C" is not acceptable. Results are summarized in Table 4.

TABLE 4

| | | Lowest Fixing Temperature | Uneven Glossiness | Glossiness |
|---|---|---|---|---|
| Example 1 | Toner 1 | 100° C. | A | B |
| Example 2 | Toner 2 | 95° C. | A | B |
| Example 3 | Toner 3 | 95° C. | A | A |
| Example 4 | Toner 4 | 90° C. | B | A |
| Example 5 | Toner 5 | 90° C. | A | A |
| Example 6 | Toner 6 | 100° C. | A | A |
| Comparative Example 1 | Toner 7 | 130° C. | A | C |
| Comparative Example 2 | Toner 8 | 85° C. | C | A |
| Comparative Example 3 | Toner 9 | 100° C. | A | C |

The samples according to the present invention demonstrate good result in any evaluation items and more advantageous than the comparative examples. Contrary comparative samples 1-3 have any problem in the evaluation items.

What is claimed is:

1. An electrophotographic toner comprising a resin and a colorant, wherein the resin comprises resin A and resin B;

the resin B is a copolymer of monomers comprising a vinyl monomer and a polycarboxylic acid selected from the group consisting of itaconic acid, maleic acid, fumaric acid, glutaconic acid, citraconic acid and mesaconic acid;

the resin B has a glass transition temperature higher than that of the resin A;

an amount of the resin B is 3 to 30% by mass of total resins of the toner; and the toner meets requirements that G' (60)/G' (80) is $1\times10^2$ to $1\times10^4$, wherein G' (60) and G' (80) are each a storage modulus of the toner at 60° C. and 80° C., respectively;

G' (100)/G' (130) is 1 to $10^2$, wherein G' (100) and G' (130) are each a storage modulus of the toner at 100° C. and 130° C., respectively; and G' (100-130) is $1\times10^2$ to $1\times10^5$ dyn/cm$^2$, wherein G' (100-130) is a storage modulus of the toner at temperature of 100 to 130° C.

2. The toner of claim 1, wherein the toner has a glass transition temperature of 20 to 45° C.

3. The toner of claim 1, wherein the polycarboxylic acid is itaconic acid or maleic acid.

4. The toner of claim 1, wherein the resin B accounts for 5 to 20% by mass of total resins of the toner.

5. The toner of claim 1, wherein the resin A has a glass transition temperature of 20 to 45° C.

6. The toner of claim 1, wherein the resin A has a weight average molecular weight of 10,000 to 50,000.

7. The toner of claim 1, wherein the resin B has a glass transition temperature of 40 to 70° C.

8. The toner of claim 1, wherein the resin B has a weight average molecular weight of 50,000 to 200,000.

9. The toner of claim 1, wherein the toner is composed of particles of the resin A and particles of resin B.

10. The toner of claim 1, wherein G' (60)/G' (80) is $1\times10^3$ to $1\times10^4$.

11. The toner of claim 1, wherein G' (100)/G' (130) is 1 to 30.

12. The toner of claim 1, wherein the value G' (100-130) is $5\times10^2$ to $5\times10^4$ dyn/cm$^2$.

13. The toner of claim 1, wherein the value G' (100) is $1\times10^4$ to $1\times10^5$ dyn/cm$^2$.

14. The toner of claim 1, wherein the value G' (130) is $5\times10^2$ to $5\times10^4$ dyn/cm$^2$.

15. The toner of claim 1, wherein the toner has a glass transition temperature of 25 to 35° C.

* * * * *